US009766037B2

(12) United States Patent
Irwin

(10) Patent No.: US 9,766,037 B2
(45) Date of Patent: Sep. 19, 2017

(54) LOCKING HOLSTER FOR A FIREARM

(71) Applicant: Kelly Irwin, Bella Vista, AR (US)

(72) Inventor: Kelly Irwin, Bella Vista, AR (US)

(73) Assignee: Assembled Products Corporation, Rogers, AR (US)

( * ) Notice: Subject to any disclaimer, the term of this patent is extended or adjusted under 35 U.S.C. 154(b) by 197 days.

(21) Appl. No.: 14/642,304

(22) Filed: Mar. 9, 2015

(65) Prior Publication Data

US 2015/0285588 A1 Oct. 8, 2015

Related U.S. Application Data

(60) Provisional application No. 61/950,531, filed on Mar. 10, 2014.

(51) Int. Cl.
*F41C 33/00* (2006.01)
*F41C 33/02* (2006.01)

(52) U.S. Cl.
CPC ..... *F41C 33/0263* (2013.01); *F41C 33/0227* (2013.01)

(58) Field of Classification Search
CPC ..... F41C 33/00; F41C 33/02; F41C 33/0227; F41C 33/0263
USPC ..... 224/243, 244, 241, 912
See application file for complete search history.

(56) References Cited

U.S. PATENT DOCUMENTS 3,419,728 A 12/1968 Wilson
4,057,181 A 11/1977 Finnigan
4,483,501 A 11/1984 Eddy
4,858,799 A * 8/1989 Young ..... F41C 33/0209 224/238
4,984,725 A 1/1991 Urbom
5,322,200 A 6/1994 Blanchard
5,449,103 A 9/1995 Tilley
5,621,996 A 4/1997 Mowl, Jr.
5,828,301 A 10/1998 Sanchez
5,916,087 A 6/1999 Owens
6,009,654 A 1/2000 Williams et al.
6,320,975 B1 11/2001 Vieweg
6,405,861 B1 6/2002 Siler et al.
6,425,538 B1 7/2002 Heren
6,467,660 B1 10/2002 Rogers et al.
6,523,374 B1 2/2003 Owens
6,533,149 B2 3/2003 Vor Keller et al.
6,585,209 B1 * 7/2003 Mattingly ..... F41C 33/0245 248/121
6,588,635 B2 7/2003 Vor Keller et al.
6,641,009 B2 11/2003 French et al.
6,843,081 B1 1/2005 Painter
6,876,756 B1 4/2005 Vieweg
6,918,519 B2 7/2005 Vor Keller et al.
7,143,913 B2 12/2006 Lindsey et al.
7,168,198 B2 1/2007 Newkirk et al.
7,200,965 B2 4/2007 Vor Keller et al.
7,353,632 B2 4/2008 Newkirk et al.
7,389,604 B2 6/2008 Newkirk et al.
(Continued)

*Primary Examiner* — Brian D Nash
(74) *Attorney, Agent, or Firm* — Boyd D. Cox

(57) ABSTRACT

An adjustable locking holster for securing a firearm against unauthorized removal of the firearm from the holster. The holster includes a security retention system that deters unauthorized removal of the firearm from the holster, while allowing authorized users to readily access and remove the firearm.

19 Claims, 6 Drawing Sheets

(56) References Cited

U.S. PATENT DOCUMENTS

| | | | | |
|---|---|---|---|---|
| 7,434,712 | B2 * | 10/2008 | Cook | F41C 33/0209 224/193 |
| 7,584,875 | B2 | 9/2009 | Lowe et al. | |
| 7,644,845 | B2 | 1/2010 | Lowe | |
| 8,006,424 | B1 | 8/2011 | Ligard | |
| 8,104,313 | B2 | 1/2012 | Wolfe | |
| 8,162,285 | B2 | 4/2012 | Rooker | |
| 8,177,108 | B1 * | 5/2012 | Kincaid | F41C 33/0209 224/193 |
| 8,251,266 | B2 | 8/2012 | Gregory et al. | |
| 8,281,511 | B1 | 10/2012 | Ligard | |
| 8,469,245 | B2 | 6/2013 | Gregory et al. | |
| 8,517,234 | B2 | 8/2013 | Kincaid et al. | |
| 8,646,665 | B2 * | 2/2014 | Abushaev | F41C 33/0281 224/243 |
| 9,057,579 | B2 * | 6/2015 | Rorick | F41C 33/02 |
| 2002/0032976 | A1 | 3/2002 | Riener | |
| 2004/0064993 | A1 | 4/2004 | Klein | |
| 2005/0279788 | A1 * | 12/2005 | Lowe | F41C 33/0209 224/244 |
| 2006/0175366 | A1 * | 8/2006 | Dekaise | F41C 33/0227 224/243 |
| 2008/0179360 | A1 * | 7/2008 | Lowe | F41C 33/0209 224/243 |
| 2010/0243492 | A1 * | 9/2010 | Bulthuis, Jr. | F41C 33/06 206/317 |
| 2013/0001112 | A1 * | 1/2013 | Negrini | F41C 33/0209 206/223 |
| 2015/0285587 | A1 * | 10/2015 | Abushaev | F41C 33/0209 224/193 |

* cited by examiner

LOCKING HOLSTER FOR A FIREARM

Priority for this application is claimed from U.S. Provisional Application No. 61/950,531 entitled "Locking Holster For A Firearm" filed on Mar. 10, 2014

BACKGROUND

The present invention is directed to an adjustable locking holster for securing a firearm, wherein the holster deters unauthorized removal of the firearm. In particular, the holster of the present invention includes a security retention system that releasably secures the firearm and deters unauthorized users to access the firearm, while allowing authorized users to readily remove the firearm from the holster.

Many firearm users, including law enforcement personnel, store their firearms in a holster that is generally designed to protect the firearm and hold the firearm securely therein. In certain emergency instances, an officer of the law must have quick access to his or her firearm. Therefore, the firearm must be easily accessible and quickly available for use. When stored in a holster, the firearm needs to be readily removable from that holster. However, when not in use the firearm needs to be securely retained within the holster.

Known holsters include a strap for securing a firearm within the holster. In these holsters, the strap is positioned over the rear end of the firearm and secured. The strap is typically secured into place by a snap fastener. The snap fastener is then disengaged to release the firearm from the holster when the firearm is needed.

While these known holsters can successfully retain a weapon therein, there are drawbacks with this type of holster securement device. The snap fastener can be opened by anyone to release the firearm stored therein. Consequently, an unauthorized user, such as a criminal or a suspect, can easily remove the weapon from the holster by unsnapping the fastener to release the securement strap and extracting the firearm. The strap fails to secure the firearm against unauthorized access, thereby allowing anyone proximate the holster to access, remove and use the firearm. This can create a dangerous situation, especially for law enforcement officials apprehending a suspect when close proximity to the suspect is required.

There is a need for a secure storage location in which to keep firearms within a vehicle, at home or in the office. When the firearm is not in immediate possession of a designated user, it can become an object of theft or unauthorized use. Certainly danger exists when untrained individuals, such as juveniles, gain access to firearms. However, in cases of law enforcement especially, the necessity arises for an officer to take rapid possession of his or her firearm. Therefore, there is a need to provide a holster that not only can limit access to a firearm, but also can provide ready access to the weapon.

The holster of the present invention provides a housing having a pivoting hood that secures a firearm within the holster. The holster further includes a security retention system that locks the pivoting hood against movement so that when the hood is in a closed position and the security retention system is locked, removal of the firearm from the holster is deterred. While the security retention system deters unauthorized access to a firearm locked in the holster, conversely, the holster provides easy access for an authorized user to release a firearm stored therein. The holster enables authorized users to unlock the locking mechanism and release the firearm for use.

The holster includes a mounting bracket for mounting the invention on a variety of surfaces. This enables the holster to be positioned in locations that are easily accessible to the designated user, including a motor vehicle, home or office.

SUMMARY

The present invention relates to a holster for safely retaining a firearm against unauthorized access. The holster has a security retention system for locking the firearm within the holster and, furthermore, for providing selective access to the firearm. More particularly, the invention is a holster that includes a housing for holding the firearm and a pivoting hood for retaining the firearm within the housing. A locking mechanism locks the hood against pivoting movement, and thereby deters unauthorized users to access the firearm locked in the holster, while allowing selected authorized users to release the firearm from the holster.

It is an object of the present invention to provide secure storage for a firearm when not in use.

It is a further object of the present invention to provide a holster for safely storing a handgun, wherein the holster can be mounted in various locations and at various positions.

It is a further object of the present invention to provide a holster that can be adjusted to fit a variety of different styles and types of firearms.

It is a further object of the present invention to provide a holster with a pivoting bail that locks a firearm in the holster.

It is a further object of the present invention to provide a holster that can hold an item such as a handgun, taser, tactical light or laser grip.

It is a further object of the present invention to provide a holster that can releasably hold an item such as a handgun, taser, tactical light or laser grip and secure the item against unauthorized removal.

It is a further object of the present invention to provide a holster having a security retention system to lock a firearm within the holster.

It is a further object of the present invention to provide a holster for supporting a firearm that protects the firearm from damage.

It is a further object of the present invention to provide a holster that protects a firearm from dirt, dust and scratches.

It is a further object of the present invention to provide a holster with a pivoting hood that can be readily moved between a closed/locked configuration in which a firearm supported therein is secured and an open/unlocked configuration in which a firearm supported therein is unsecured.

It is a further object of the present invention to provide a holster with a quick flip bail that can lock a firearm in the holster.

It is a further object of the present invention to provide a holster having a trigger guard section that blocks access to the trigger of a stored firearm.

It is a further object of the present invention to provide a holster with a trigger guard section that deters unwanted operation of the stored firearm's trigger.

BRIEF DESCRIPTION OF THE DRAWINGS

Reference is made to the accompanying drawings in which are shown illustrative embodiments of the invention and from which novel features and advantages will be apparent.

DETAILED DESCRIPTION

Figure 1:
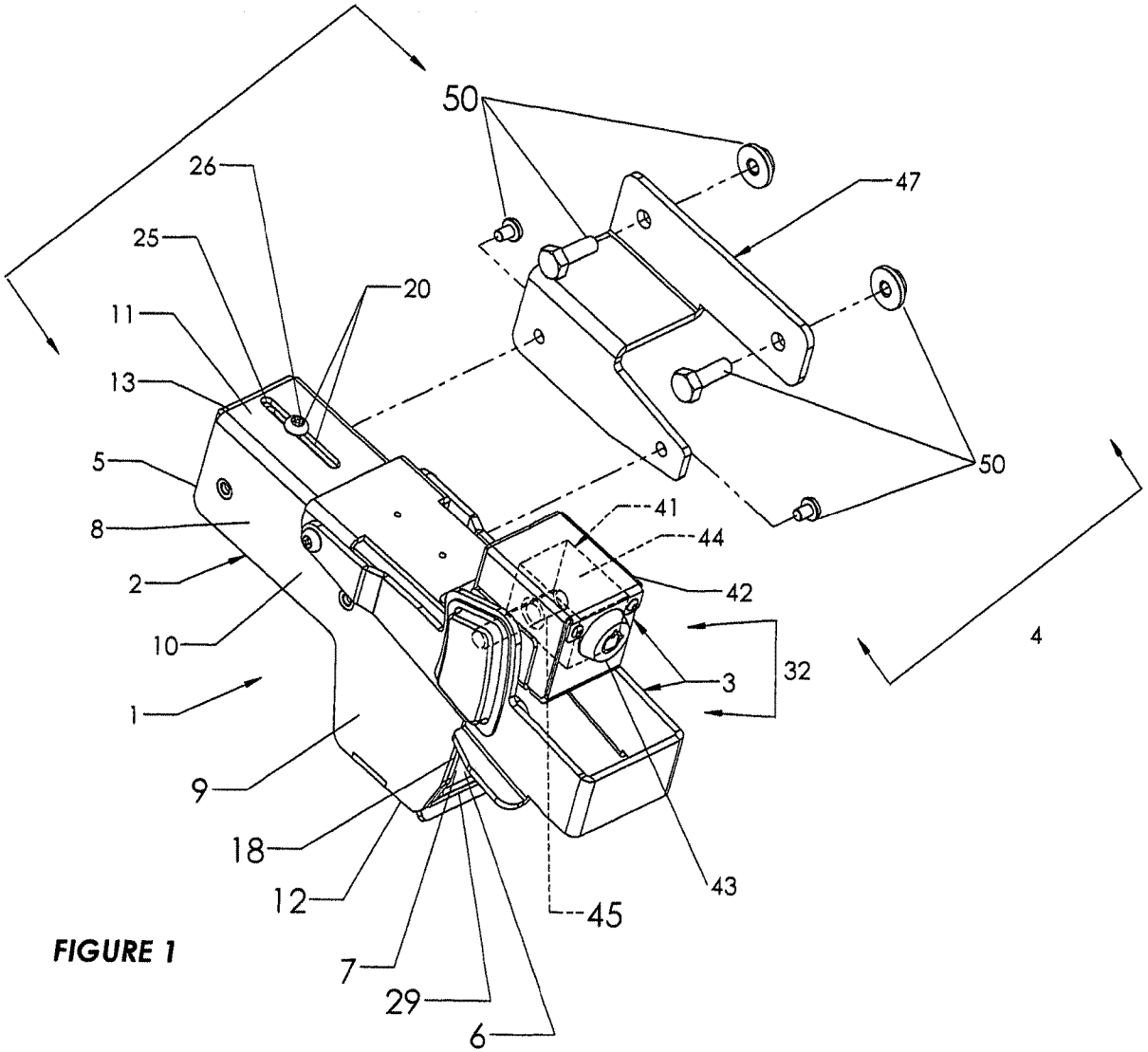
FIG. 1 is a perspective view of a preferred embodiment of the holster of the present invention with the mounting bracket removed.

The adjustable locking holster (1) of the present invention as shown in FIGS. 1-7 includes a housing (2), a security retention system (3), and a holster mount (4) for attaching the housing (2) and security retention system (3) to a support surface.

The housing (2) is comprised of a hollow body (5) having a cavity (6) and an entry opening (7) which provides access into the cavity (6). The hollow body (5) is formed by a plurality of walls and includes a barrel guard section (8) and a trigger guard section (9). The plurality of walls comprises side walls (10), a top wall (11), a bottom wall (12) and an end wall (13).

Within the hollow body (5), the cavity (6) includes a barrel receiving area (14) and a trigger receiving area (15). The barrel receiving area (14) is adapted to hold the barrel (B) of a firearm (A) stored in the holster and defines an interior region within the hollow body's barrel guard section (8). The trigger receiving area (15) is adapted to encase the trigger guard (C) of a firearm (A) stored in the holster (1) and defines an interior region within the hollow body's trigger guard section (9).

The holster (1) also has means for adjusting the cavity (6) which functions to alter the effective size of the cavity (6) in order to accommodate differently sized weapons. The means for adjusting the cavity includes first (16) and second (17) adjustment devices. The first adjustment device (16) comprises means for adjusting the barrel receiving area (14) of the cavity in order to accommodate various barrel lengths exhibited by different firearms. The second adjustment device (17) comprises means for adjusting the trigger receiving area (15) of the cavity in order to create a snug fit for the firearm in the trigger receiving area (15). A snug fit of the firearm within the trigger receiving area (15) ensures that the firearm will be securely retained within the holster (I).

The cavity (6) has a cushioned lining (18) that protects a stored firearm from damage and provides a closer tolerance for fitting a firearm within the housing's cavity (6). Preferably, the cushioned lining (18) is comprised of leather. However, any suitable cushioning material, including neoprene, nylon, plastic or felt, could be used instead.

Figure 2:
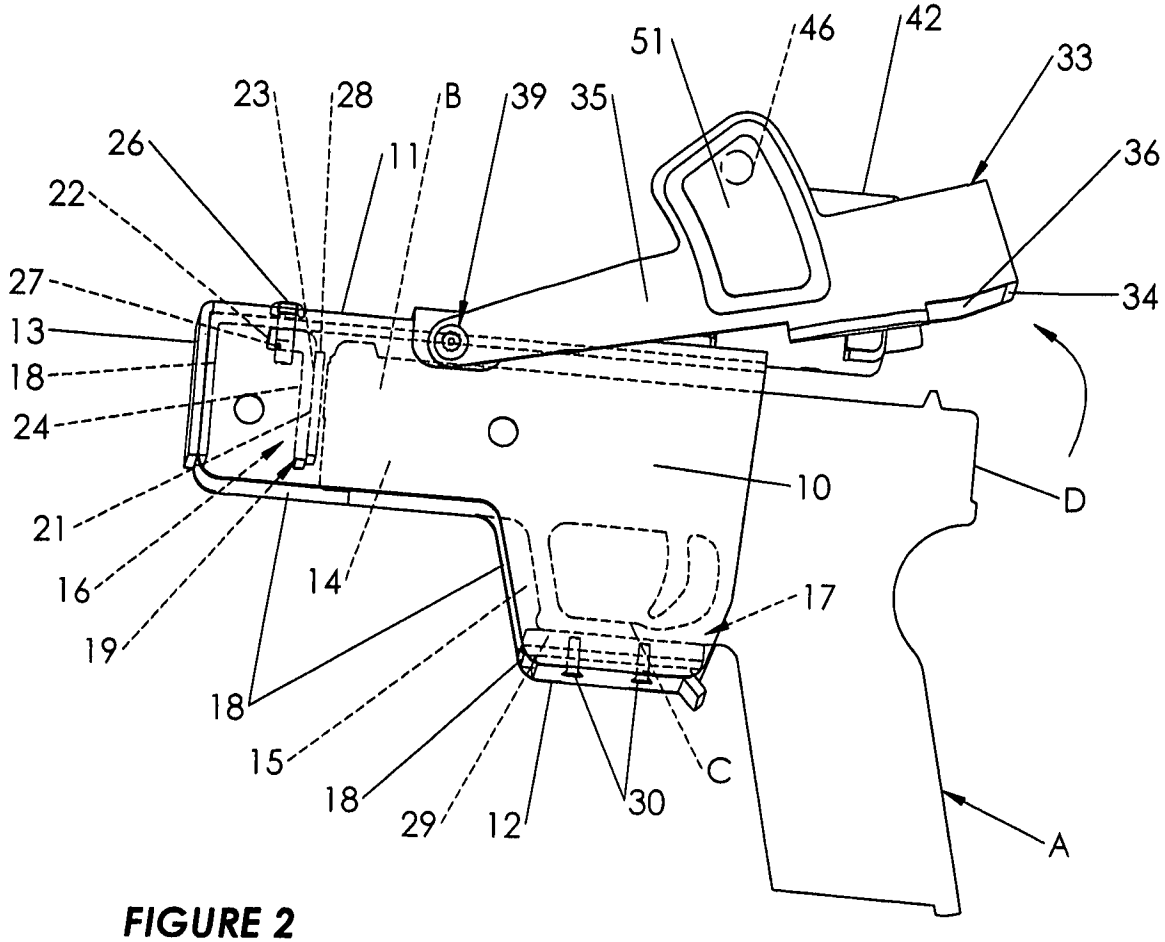
FIG. 2 is a perspective view of the holster of FIG. 1 shown with a firearm supported therein and with the holster in the open/unlocked configuration.
Figure 6:
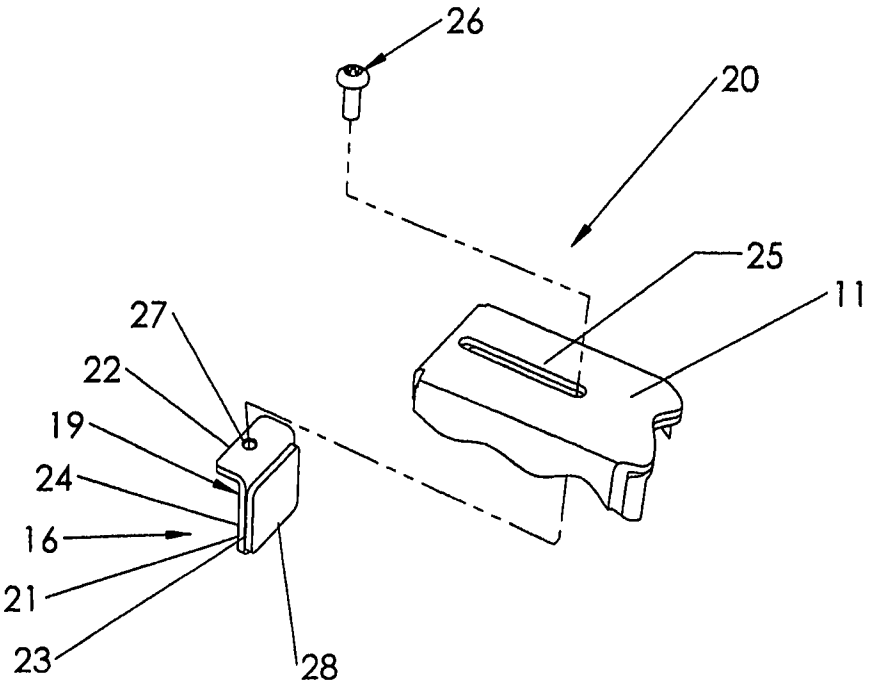
FIG. 6 is a partially exploded view of the first adjustment device of the holster of the present invention shown in FIG. 1.
Figure 7:
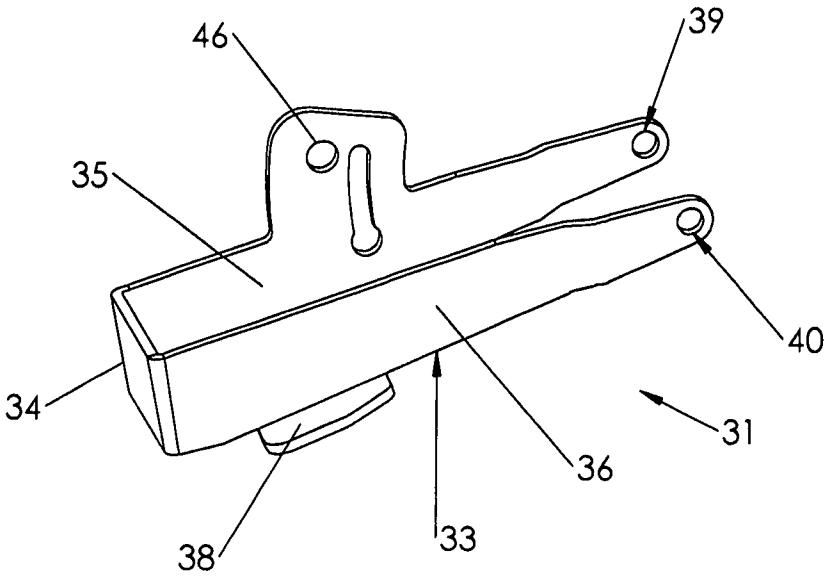
FIG. 7 is a perspective view of the pivoting hood of the holster of the present invention shown in FIG. 1.

As shown in FIGS. 2 and 6, the first adjustment device (16) is a barrel stop (19) comprised of an L-shaped sliding bracket and an adjustable securing system (20). The barrel stop (19) is disposed within the barrel receiving area (14). The barrel stop (19) includes an abutment wall (21) and an attaching wall (22). The abutment wall (21) has a front side (23) and a rear side (24). The front side (23) of the abutment wall (21) faces toward the entry opening (7) of the housing (2) and the rear side (24) faces away from the entry opening (7).

The adjustable securing system (20) includes a slot (25) disposed in the hollow body (5) and a tamperproof screw (26) that extends through the slot (25) and engages a cooperating threaded aperture (27) in the attaching wall (22) of the barrel stop (19). The adjustable securing system (20) is adjustable to allow positioning of the barrel stop (19) in a desired location within the barrel receiving area (14). Although the adjustable securing system (20) comprises a slot (25) and tamperproof screw (26) in the preferred embodiment shown, other suitable adjustment devices could be used instead to adjust the position of the barrel stop (19) within the cavity (6) of the housing (2).

The cushioned lining (18) further comprises a barrel cushion (28) disposed on the abutment wall (21) of the barrel stop (19). The barrel cushion (28) protects the end of the firearm's barrel from damage.

The second adjustment device (17) is positioned in the trigger receiving area (15) of the cavity (6) and comprises a trigger guard shim (29) and shim screws (30). The trigger guard shim (29) is a plate having threaded apertures therein. The trigger guard shim (29) is adapted to fit between the trigger guard of a firearm and the trigger guard section (9) of the housing (2).

Preferably, the trigger guard shim (29) is made of plastic, although other suitable materials, such as nylon or composites, could be substituted therefor. The shim screws (30) engage threaded apertures in the trigger guard shim (29) to secure the shim (29) to the trigger guard section (9) of the hollow body (5). To adjust the effective size of the trigger receiving area (15), the trigger guard shim (29) can be installed or removed from the cavity (6). By removing the trigger guard shim (29), the effective size of the trigger receiving area (15) is increased. With the trigger guard shim (29) installed, the effective size of the trigger receiving area (15) is decreased. Consequently, the trigger guard shim (29) is installed when there is slack space between the trigger guard of the firearm and the trigger guard section (9) of the housing (2). Reducing the slack space enables proper and effective locking of the firearm in the holster (1).

The security retention system (3) includes a pivoting hood (31) and a locking mechanism (32) that releasably secures the pivoting hood (31) against movement. The hood (31) comprises a U-shaped bail (33) with means for pivotally attaching the bail to the housing (2). The U-shaped bail (33) is formed of a crosspiece (34) and first (35) and second (36) elongated arms extending outwardly from the crosspiece (34). First (37) and second (38) tabs extend outwardly from the respective first (35) and second (36) arms to assist a user in manually manipulating the bail (33). A bail cap (51) is mounted on the U-shaped bail (33).

The means for pivotally attaching the bail to the hollow body (5) comprises first (39) and second (40) pivoting joints. The first joint (39) secures one end of the first arm (35) to a side wall (10) of the hollow body (5) at a location along the length of the barrel guard section (8). The second joint (40) pivotally attaches one end of the second arm (36) to a side wall (10) of the hollow body (5) that is opposite to the first joint (39) and at a location along the length of the barrel guard section (8).

Figure 3:
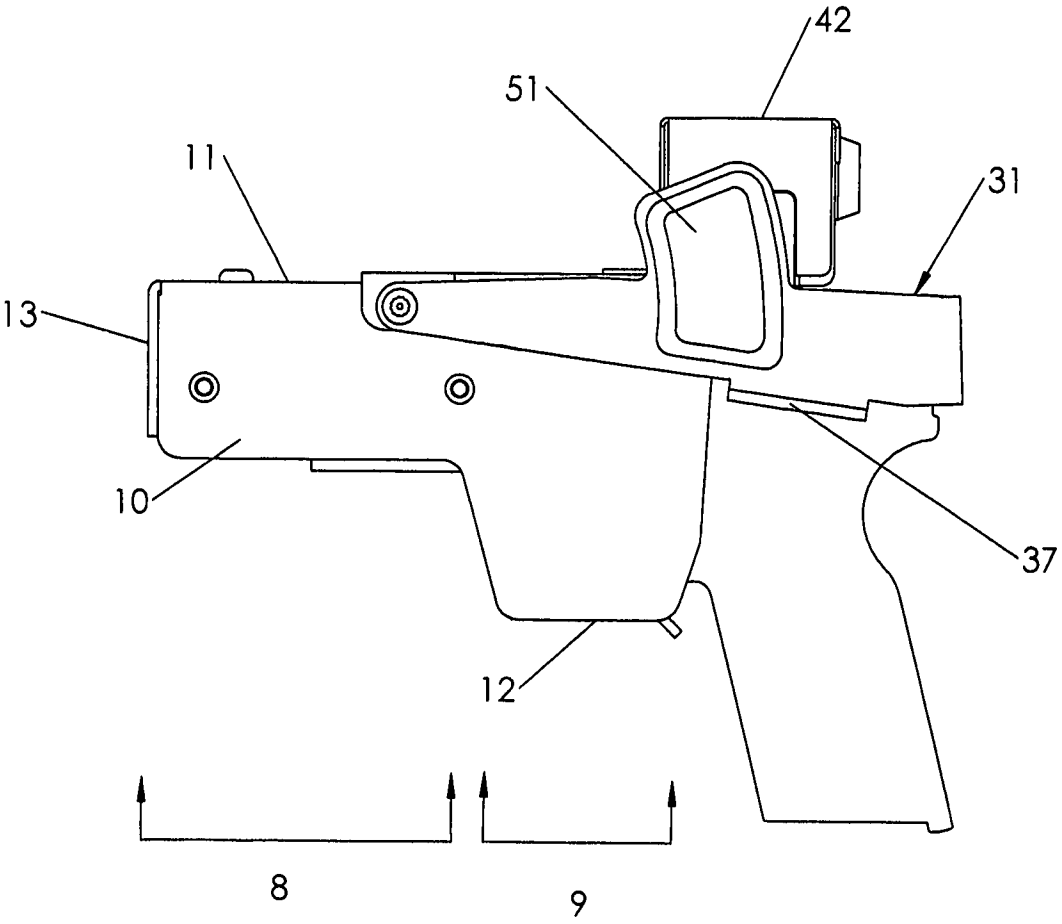
FIG. 3 is a side view of the holster of FIG. 1 shown with a firearm supported therein and with the holster in the closed/locked configuration.

The pivoting hood (31) can be moved between an opened position as shown in FIG. 2 and a closed position as shown in FIG. 3. A portion of the bail (33) extends a distance out from the housing (2) such that the crosspiece (34) is positioned away from the housing (2). When the pivoting hood (31) is in the closed position, the crosspiece (34) is positioned across the entry opening (7) of the housing (2). When a firearm is in the holster (1) and the pivoting hood (31) is in the closed position, the crosspiece (34) fits closely over the back of the firearm and retains the firearm within the housing (2).

When the pivoting hood (31) is in the open position, the bail (33) extends upwardly from the hollow body (5) with the crosspiece (34) away from the entry opening (7). In the open position with the entry opening (7) unobstructed, a firearm can be placed into the holster by inserting the firearm's barrel through the entry opening (7) and into the cavity (6) of the housing (2). The barrel is positioned in the barrel receiving area (14) and the trigger of the firearm is positioned in the trigger receiving area (15). A firearm that is stored in the holster (1) can be removed therefrom when the pivoting hood (31) is in the open position.

The locking mechanism (32) is disposed on the housing (2), specifically on the top wall (11) of the hollow body (5). The locking mechanism (32) comprises a lock element (41) and a lock casing (42) that houses the lock element (41). The lock element has a keypad (43), a lock actuator (44), a lock detent (45), and a detent receiver (46).

The user interfaces with the keypad (43) to set the lock actuator (44) in motion. When impelled, the lock actuator (44) moves the detent (45) into and out of engagement with the detent receiver (46). The detent receiver (46) comprises a socket disposed on the first arm (35) of the bail (33). The bail cap (51) is positioned over the detent receiver (46) on the first arm (35) of the U-shaped bail (33) and protects the lock detent (45) against tampering when the detent (45) is in the detent receiver (46). When the detent (45) is engaged with the detent receiver (46), the locking mechanism (32) is in the locked position and the bail (33) is secured in place. Conversely, when the lock detent (45) is disengaged from the detent receiver (46), the locking mechanism (32) is in the unlocked position and the bail (33) is free to move.

In the preferred embodiment shown, the hollow body (5), the hood (31) and the lock casing (42) are comprised of steel. However, other suitable materials, such as high impact plastic or composites, could be used instead.

In this preferred embodiment, the keypad (43) comprises a mechanical lock and key device. However, other suitable types of keypads could be substituted therefor. These suitable devices include, but are not limited to, combination, numeric and digit recognition keypads.

Figure 4:
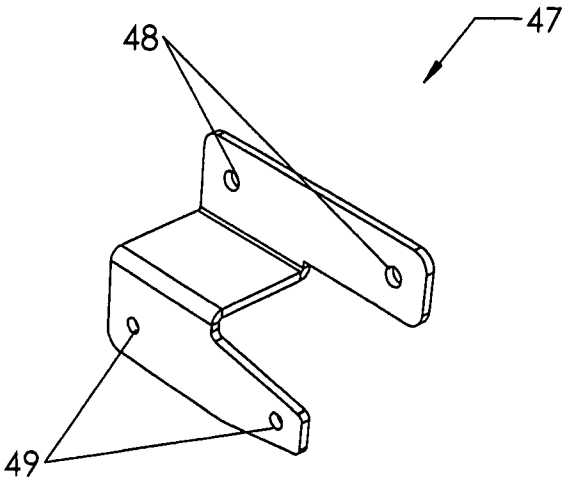
FIG. 4 is a perspective view of a preferred embodiment of the mounting bracket comprised by the holster of the present invention shown in FIG. 1.

Referring to FIGS. 1 and 4, the holster mount (4) is shown to be a mounting bracket (47) that can be attached to a variety of support surfaces. In this preferred embodiment, the mounting bracket (47) comprises three planar surfaces having a plurality of support mounting apertures (48) and a plurality of holster mounting apertures (49). Each one of a plurality of fasteners (50) is adapted to engage a respective one of said plurality of mounting apertures (48,49) in order to secure the holster (1) to the mounting bracket (47) and to secure the mounting bracket (47) to a support surface.

Figure 5:
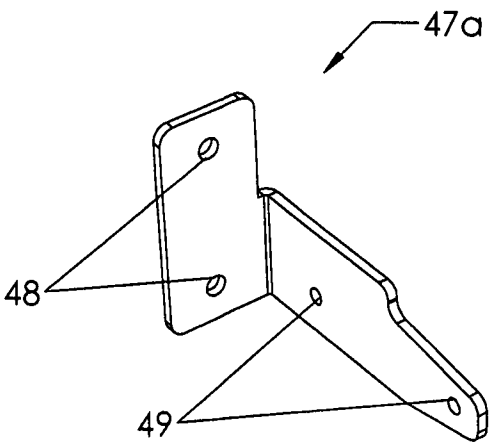
FIG. 5 is a perspective view of an alternate embodiment of a mounting bracket of the holster of the present invention shown in FIG. 1.

The shape of the holster's mounting bracket can vary depending on the support surface to which the mounting bracket is to be attached. Another preferred embodiment of the mounting bracket (47*a*) is shown in FIG. 5 having an L shape.

The holster (1) includes a plurality of configurations: a closed/locked configuration, a closed/unlocked configuration and an open/unlocked configuration.

With the holster (1) in the closed/locked configuration, the pivoting hood (31) is in the closed position and the locking mechanism (32) is in the locked position. With a firearm disposed in the housing (2) when the holster (1) is in the closed/locked configuration, the firearm is secured against unauthorized removal. In this configuration, the entry opening (7) is obstructed by the bail (33) so that a firearm cannot be removed from the holster (1).

With the holster (1) in the closed/unlocked configuration, the pivoting hood (31) is in the closed position and the locking mechanism (32) is in the unlocked position. In this configuration, a firearm positioned in the holster (1) is blocked from removal by the position of the bail (33). However, with the locking mechanism (32) being in the unlocked position, the pivoting hood (31) is free to be moved in order to release the firearm stored in the holster (1).

In the open/unlocked configuration, the pivoting hood (31) is in the opened position and the locking mechanism (32) is in the unlocked position. In this position, the crosspiece (34) does not obstruct the entry opening (7) into the cavity (6), so that the holster (1) is completely opened, allowing a firearm to be inserted into or removed from the housing (2).

As a preferred method of installing the holster (1) of the present invention, the housing (2) is first adjusted to the desired size for the firearm that is to be held therein; the mounting bracket (47) is secured to a support surface; and the housing (2) is attached to the mounting bracket (47).

To adjust the housing (2) to the desired size, the tamperproof screw (26) is loosened thereby allowing the barrel stop (19) to slide freely back and forth. The firearm is inserted through the entry opening (7) and into the cavity (6) with the firearm positioned so that barrel of the firearm is directed into the barrel receiving area (14) and the trigger is directed into the trigger receiving area (15). With the trigger guard shim (29) installed, the user then assesses the size of the space between the firearm's trigger guard and trigger guard section (9). If the trigger guard fails to completely fit into the trigger receiving area (15), then the trigger guard shim (29) is removed from the trigger receiving area (15) to make room for the incoming trigger guard. To remove the trigger guard shim (29), the shim screws (30) attaching the shim (29) to the hollow body (5) are loosened, thereby releasing the shim (29) from the trigger guard section (9) and the shim (29) is lifted out. It should be appreciated that if there is slack space in the trigger receiving area (15) between the trigger guard and the trigger guard section (9), a shim (29) can be added.

After the trigger receiving area (15) is properly adjusted, the firearm is inserted into the cavity (6) of the holster's housing (2). The barrel stop (19) is free to slide if contacted by the barrel during insertion of the firearm into the housing (2).

With the firearm positioned in the holster (1), the firearm's barrel is disposed in the barrel receiving area (14) and the trigger is disposed in the trigger receiving area (15). Next, the hood (31) is pivoted into the closed position with the crosspiece (34) of the bail (33) adjacent to a rear side (D) of the firearm. The barrel stop (19) is then moved to fit snugly against the end of the firearm's barrel and the tamperproof screw (26) is tightened to lock the barrel stop (19) in place.

The mounting bracket (47) is then secured to a selected support surface. To secure the mounting bracket (47) to the support surface, mounting fasteners (50) are extended through corresponding support mounting apertures (48) in the mounting bracket (47) and then the fasteners (50) are attached to the support surface. Finally, the housing (2) is attached to the mounting bracket (47) via mounting fasteners (50). The mounting fasteners (50) are extended through respective holster mounting apertures (49) disposed in the mounting bracket and then secured to the hollow body (5).

To secure a firearm or handgun in the holster (1), the locking mechanism (32) is placed into the unlocked position and the hood (31) is moved to an opened position away from the entry opening (7). With the hood (31) in the opened position, the entry opening (7) into the cavity (6) is unobstructed by the bail (33). The firearm is then inserted into the cavity (6) of the housing (2) so that the barrel of the firearm is disposed in the barrel receiving area (14) and the trigger of the firearm is disposed in the trigger receiving area (15). The hood (31) is then pivoted downwardly into its closed position where the crosspiece (34) of the bail (33) is adjacent to a rear side (D) of the firearm and the hood (31) extends around the rear side (D) of the firearm. Using the keypad (43), a user initiates the lock actuator (44) to activate the lock detent (45). When the locking mechanism is activated to move from its unlocked position into its locked position, the lock detent (45) slides from the lock casing (42) and into the detent receiver (46) to secure the pivoting hood (31) in place. With the pivoting hood (31) in the closed position and the locking device in the locked position, the holster is in the closed/locked configuration and the firearm is secured in place.

To release a firearm from the holster (1), the locking mechanism (32), which is controlled by an authorized user via the keypad (43), is activated to move into the unlocked position from the locked position. This causes the lock actuator (44) to retract the lock detent (45) from its position in the detent receiver (46). The holster is now in the closed/unlocked configuration in which the hood (31) is still in a position that obstructs removal of the firearm from the hollow body (5). However, the hood (31) is free to be pivoted by the user into the opened position. To remove the firearm from the holster (1), the user pivots the hood (31) into the opened position in which the crosspiece (34) of the bail (33) is away from the rear of the firearm, thereby releasing the firearm for removal from the holster (1).

The present invention provides a means for securing a firearm, such as a handgun, in selected locations wherein access to the firearm secured in a locking holster is limited to authorized users. Having a device that secures and stores a firearm provides protection against unauthorized personnel accessing the firearm and causing harm to himself or herself or to others. By denying access to unauthorized individuals, the locking holster also deters the theft of firearms from homes, offices and vehicles.

Although the present invention has been described in considerable detail with reference to certain preferred versions thereof, other versions are possible. Therefore, the spirit and scope of the appended claims should not be limited to the description of the preferred versions contained herein.

The invention claimed is:

1. A locking holster for releasably securing a firearm having a barrel and a trigger, said locking holster comprising:

a housing; and a security retention system;

said housing includes a cavity for receiving the firearm therein and means for adjusting a size of the cavity;

wherein said cavity includes a barrel receiving area for holding the barrel of the firearm supported within the locking holster, and a trigger receiving area for receiving the trigger of the firearm supported within the locking holster; and said security retention system comprises a locking mechanism and a pivoting hood.

2. The locking holster of claim 1, wherein said housing comprises means for adjusting the barrel receiving area of the cavity.

3. The locking holster of claim 2, wherein said means for adjusting the barrel receiving area comprises a barrel stop and an adjustable securing system;

wherein said adjustable securing system selectively attaches the barrel stop within the barrel receiving area of the housing.

4. The locking holster of claim 3, wherein said barrel stop comprises a sliding bracket disposed within the barrel receiving area of the cavity.

5. The locking holster of claim 4, wherein said adjustable securing system comprises at least one screw, a slot disposed in said housing, and a threaded aperture in said barrel stop, wherein said at least one screw extends through said slot and engages said threaded aperture in said barrel stop.

6. The locking holster of claim 5, wherein said barrel stop is generally L-shaped and includes an abutment wall and an attaching wall, wherein said threaded aperture is disposed in said attaching wall.

7. The locking holster of claim 6, wherein said barrel stop further comprises a barrel cushion disposed on the abutment wall to protect the end of the firearm's barrel.

8. The locking holster of claim 1, wherein said means for adjusting the cavity comprises means for adjusting the trigger receiving area of the cavity.

9. The locking holster of claim 8, wherein said means for adjusting the trigger receiving area comprises a removeable trigger guard shim and at least one shim screw, wherein to reduce an effective size of the trigger receiving area, said trigger guard shim is disposed within the trigger receiving area and secured to the housing by the at least one shim screw.

10. The locking holster of claim 1, wherein said housing includes side walls, a top wall, a bottom wall and an end wall.

11. The locking holster of claim 10 wherein said housing further comprises an entry opening into said cavity;

said pivoting hood comprises a generally U-shaped bail;

said U-shaped bail comprises a crosspiece and first and second elongated arms extending outwardly from the crosspiece;

wherein said first elongated arm is pivotally secured to a first side wall of the housing by a first pivotal joint, and said second elongated arm is pivotally attached to a second side wall of the housing by a second pivotal joint.

12. The locking holster of claim 1, wherein said holster further comprises a closed/locked configuration, a closed/unlocked configuration, and an open/unlocked configuration;

wherein in said closed/locked configuration, said pivoting hood is in a closed position and said locking mechanism is in a locked position such that the pivoting hood is held against pivotal movement on the housing and a firearm held within the holster is secured against removal;

wherein in said closed/unlocked configuration said pivoting hood is in said closed position and said locking mechanism is in an unlocked position and that said pivoting hood is free to pivot on the housing; and wherein in said open/unlocked configuration said pivoting hood is in an opened position and said locking mechanism is in said unlocked position, such that a firearm held within the holster can be readily removed.

13. A locking holster for releasably securing a firearm having a barrel and a trigger, said locking holster comprising:

a housing, a security retention system and a holster mount;

said housing comprising:

a plurality of walls forming a hollow body;

a cavity within the hollow body for receiving the firearm therein; and an entry opening into said cavity;

said plurality of walls including side walls, a top wall, a bottom wall, and an end wall;

said cavity including a barrel receiving area for receiving the barrel of the firearm supported therein, and a trigger receiving area for receiving the trigger of the firearm supported therein;

said housing further comprising a cushioned lining disposed within said cavity, wherein said cushioned lining at least partially covers the walls inside of the cavity;

said housing including a first adjustment device for adjusting the barrel receiving area and a second adjustment device for adjusting the trigger receiving area;

said first adjustment device comprising a barrel stop and an adjustable securing system, wherein said adjustable securing system selectively attaches the barrel stop within the barrel receiving area of the housing;

said security retention system including a locking mechanism and a pivoting hood;

said pivoting hood comprises a generally U-shaped bail and first and second pivotal joints for pivotally attaching said bail to the housing;

said U-shaped bail comprising a crosspiece and first and second elongated arms extending outwardly from the crosspiece;

said first elongated arm having one end attached to the crosspiece and another end pivotally secured to a first side wall of the housing by said first pivotal joint;

and said second elongated arm having one end attached to the crosspiece and another end pivotally secured to a second side wall of the housing by said second pivotal joint;

said U-shaped bail including a first tab extending outwardly from said first elongated arm;

said U-shaped bail further including a second tab extending outwardly from said second elongated arm; and said locking mechanism having a lock element and a lock casing;

said lock element including a lock actuator, a lock detent, a key pad and a detent receiver; wherein said lock actuator moves the lock detent into and out of engagement with the detent receiver and said key pad controls the lock actuator;

said detent receiver comprising a socket disposed in said pivoting hood;

said barrel stop comprising an L-shaped, sliding bracket disposed within the barrel receiving area of the cavity of the housing;

said barrel stop including an abutment wall and an attaching wall; wherein said abutment wall has front and rear sides, wherein said front side faces toward the entry opening and said rear side faces toward said end wall of the housing;

said barrel stop further comprising a barrel cushion disposed on the front side of the abutment wall;

said adjustable securing system comprising at least one screw, a slot disposed in said top wall of the housing, and a threaded aperture in said attaching wall of the barrel stop, wherein said at least one screw extends through said slot and engages said threaded aperture;

said second adjustment device including a removeable trigger guard shim and at least one shim screw, wherein to reduce an effective size of the trigger receiving area, said trigger guard shim is disposed within the trigger receiving area and secured to the bottom wall of the housing by the at least one shim screw;

said holster mount comprising a mounting bracket and fasteners to attach said housing to said mounting bracket and said mounting bracket to a supporting surface, wherein said mounting bracket includes a plurality of apertures for receiving the fasteners therethrough.

14. A locking holster for releasably securing a firearm having a barrel and a trigger, said locking holster comprising:

a housing; and a security retention system;

said housing includes a cavity for receiving the firearm therein;

said cavity includes a barrel receiving area for holding the barrel of the firearm supported within the locking holster and a trigger receiving area for receiving the trigger of the firearm supported within the locking holster; and said barrel receiving area of the housing further comprises means for adjusting the barrel receiving area.

15. A locking holster for releasably securing a firearm having a barrel and a trigger, said locking holster comprising:

a housing; and a security retention system;

said housing includes a cavity for receiving the firearm therein;

said cavity includes a barrel receiving area for holding the barrel of the firearm supported within the locking holster and a trigger receiving area for receiving the trigger of the firearm supported within the locking holster;

said security retention system comprises a locking mechanism and a pivoting hood;

said locking mechanism comprises a lock element; and said lock element includes a lock actuator, a lock detent, a key pad and a detent receiver on the hood, wherein said lock actuator moves the lock detent into and out of engagement with the detent receiver.

16. A locking holster for releasably securing a firearm having a barrel and a trigger, said locking holster comprising:

a housing; and a security retention system;

said security retention system comprises a locking mechanism and a pivoting hood, said housing including a cavity for receiving the firearm therein;

said cavity includes a barrel receiving area for holding the barrel of the firearm supported within the locking holster and a trigger receiving area for receiving the trigger of the firearm supported within the locking holster;

said barrel receiving area of the housing comprises a first adjustment device for adjusting the barrel receiving area and said trigger receiving area of the housing comprises a second adjustment device for adjusting the trigger receiving area;

said first adjustment device comprises a barrel stop and an adjustable securing system;

said barrel stop comprises a sliding bracket disposed within the barrel receiving area of the cavity;

said adjustable securing system comprises at least one screw, a slot disposed in said housing, and a threaded aperture in said barrel stop, wherein said at least one screw extends through said slot and engages said threaded aperture in said barrel stop; and wherein said adjustable securing system attaches the barrel stop at selected positions within the barrel receiving area of the housing.

17. The locking holster of claim 16, wherein said barrel stop is generally L-shaped and includes an abutment wall and an attaching wall, wherein said threaded aperture is disposed in said attaching wall.

18. The locking holster of claim 17, wherein said barrel stop further comprises a barrel cushion disposed on the abutment wall to protect the end of the firearm's barrel.

19. A locking holster for releasably securing a firearm having a barrel and a trigger, said locking holster comprising:

a housing; and a security retention system;

said housing including a cavity for receiving the firearm therein;

wherein said cavity includes a barrel receiving area for holding the barrel of the firearm supported within the locking holster, and a trigger receiving area for receiving the trigger of the firearm supported within the locking holster;

said barrel receiving area of the housing comprises a first adjustment device for adjusting the barrel receiving area and said trigger receiving area of said housing comprises a second adjustment device for adjusting the trigger receiving area;

said security retention system comprises a locking mechanism and a pivoting hood;

said locking mechanism includes a lock element; and said lock element comprises a lock actuator, a lock detent, a key pad and a detent receiver on the hood, wherein said lock actuator moves the lock detent into and out of engagement with the detent receiver.

* * * * *